US011271347B2

(12) United States Patent
Moll et al.

(10) Patent No.: US 11,271,347 B2
(45) Date of Patent: Mar. 8, 2022

(54) ELECTRICAL CONNECTOR WITH TERMINAL ALIGNMENT AND PROTECTION PLATE

(71) Applicant: TE Connectivity Services GmbH, Schaffhausen (CH)

(72) Inventors: Hurley Chester Moll, Hershey, PA (US); Eric J. Torrey, Bloomfield Hills, MI (US); Galen M. Martin, Middletown, PA (US)

(73) Assignee: TE Connectivity Services GmbH

( * ) Notice: Subject to any disclaimer, the term of this patent is extended or adjusted under 35 U.S.C. 154(b) by 2 days.

(21) Appl. No.: 16/934,078

(22) Filed: Jul. 21, 2020

(65) Prior Publication Data

US 2022/0029353 A1 Jan. 27, 2022

(51) Int. Cl.
*H01R 13/625* (2006.01)
*H01R 13/631* (2006.01)
*H01R 13/627* (2006.01)

(52) U.S. Cl.
CPC ..... *H01R 13/631* (2013.01); *H01R 13/6275* (2013.01)

(58) Field of Classification Search
CPC ..... H01R 13/631; H01R 13/6275
USPC ..... 439/345
See application file for complete search history.

(56) References Cited

U.S. PATENT DOCUMENTS

| | | | | |
|---|---|---|---|---|
| 3,846,737 | A * | 11/1974 | Spaulding | H05K 7/1069 439/331 |
| 5,501,606 | A * | 3/1996 | Oda | H01R 13/631 439/140 |
| 6,305,990 | B1 * | 10/2001 | Ward | H01R 13/432 439/752 |
| 6,761,568 | B2 * | 7/2004 | Bakker | H01R 13/631 439/140 |
| 6,773,272 | B2 | 8/2004 | Koehler et al. | |
| 7,080,990 | B1 | 7/2006 | Juntwait et al. | |
| 8,075,351 | B2 * | 12/2011 | Park | H01R 13/4538 439/752 |
| 8,469,752 | B2 * | 6/2013 | Park | H01R 13/62911 439/752 |
| 9,509,093 | B2 * | 11/2016 | Shimizu | H01R 13/627 |
| 10,312,626 | B2 * | 6/2019 | Vasbinder | H01R 13/631 |
| 10,455,712 | B1 | 10/2019 | Malecke et al. | |
| 10,700,462 | B2 * | 6/2020 | Schneider | H01R 13/506 |
| 2021/0143582 | A1 * | 5/2021 | Hengel | H01R 13/6453 |

* cited by examiner

*Primary Examiner* — Abdullah A Riyami
*Assistant Examiner* — Vladimir Imas

(57) ABSTRACT

An electrical connector assembly having a housing and a terminal alignment and protection plate. A mating surface of the housing has terminal alignment member receiving channels. The terminal alignment member receiving channels have first retention projections and second retention projections which extend into the terminal alignment member receiving channels. Rigid support members extend from a first surface of the terminal alignment and protection plate in a direction away from a second surface. The support members extend perpendicular to a planar portion of the terminal alignment and protection plate. The support members have flexible support beams which extend between the support members. The flexible support beams extend essentially parallel to the planar portion of the terminal alignment and protection plate.

20 Claims, 9 Drawing Sheets

ELECTRICAL CONNECTOR WITH TERMINAL ALIGNMENT AND PROTECTION PLATE

FIELD OF THE INVENTION

The invention is directed to an electrical connector assembly with a terminal alignment and protection plate. In particular, the invention is directed to an electrical connector assembly in which the alignment and protection plate which is moveable between a first position and a second position and which facilitates proper alignment with a mating connector assembly.

BACKGROUND OF THE INVENTION

In many applications, connector assemblies and harnesses must be assembled and/or preassembled, where one part of the connector is not mated with the corresponding connector until sometime further in the overall assembly process. Thus, this requires a great deal of care for connectors of the type having a header and a plurality of upstanding tabs and/or pins.

Although the connector housing may partially surround the electrical contacts within the receiving cavity, the electrical contacts may be exposed to the ambient environment through the open front end. During shipping or handling of the electrical connectors, contaminants may enter the receiving cavity through the front end. In addition, the front end may permit objects to enter the receiving cavity and engage the electrical contacts thereby moving and/or bending the electrical contacts. If an electrical contact is not positioned properly within the receiving cavity, the electrical contact may improperly engage the mating connector, an incident referred to as stubbing, which can damage the electrical contact. In some cases, the damage may require the electrical contact or, potentially, the entire electrical connector to be replaced.

In some connection systems, the headers are provided with freestanding pins without any type of support surrounding the pins. In other connection systems, alignment plates may be provided. Such alignment plates have a plurality of holes for receiving the terminal pin portions to maintain the alignment and spacing of the pin portions and prevent bending thereof or damage thereto. The alignment plates may be removed or remain in place before the connector is mated, or it has been known to provide an arrangement whereby the alignment plate moves from an outer protecting position, inwardly along the pin portions to an inner mating position, such as during insertion of the pin portions into holes in a printed circuit board.

Although alignment plates can be effective, alignment plates can easily be moved during shipping from an initial or first position, in which the terminal pins are protected, to a final or second position, in which the terminal pins are not protected.

It would, therefore, be beneficial to provide a terminal alignment and protection plate which cannot be easily moved to a final position during shipping. It would be beneficial to provide an electrical connector assembly in which the alignment and protection plate facilitates the alignment of the connector assembly with a mating connector assembly.

SUMMARY OF THE INVENTION

An embodiment is directed to an electrical connector assembly having a housing and a terminal alignment and protection plate. The housing has a plurality of terminals mounted in the housing with terminal mating portions projecting from a mating surface of the housing. The mating surface has terminal alignment member receiving channels which extend into the housing. The terminal alignment member receiving channels have first retention projections and second retention projections which extend into the terminal alignment member receiving channels. The terminal alignment and protection plate has a plurality of terminal receiving openings for receiving mating portions of the terminals therein. The terminal alignment and protection plate has a first surface and an oppositely facing second surface, with the first surface facing the mating surface of the housing. Rigid support members extend from the first surface of the terminal alignment and protection plate in a direction away from the second surface. The support members extend perpendicular to a planar portion of the terminal alignment and protection plate. The support members have flexible support beams which extend between the support members. The flexible support beams extend essentially parallel to the planar portion of the terminal alignment and protection plate.

When the terminal alignment and protection plate is spaced from the mating surface of the housing, the flexible support beams are provided in the terminal alignment member receiving channels and are retained between the first retention projections and the second retention projections. When the terminal alignment and protection plate is adjacent the mating surface of the housing, the flexible support beams are provided in the terminal alignment member receiving channels and are positioned beyond the second retention projections.

An embodiment is directed to an electrical connector assembly which includes a housing and a terminal alignment and protection plate. The housing has a plurality of terminals mounted in the housing with terminal mating portions projecting from a mating surface of the housing. The terminal alignment and protection plate has a planar portion with a plurality of terminal receiving openings for receiving mating portions of the terminals therein. The planar portion has a first surface and an oppositely facing second surface, with the first surface facing the mating surface of the housing. Alignment ribs extend from the second surface of the planar portion of the terminal alignment and protection plate in a direction away from the first surface. The alignment ribs extending perpendicular to the second surface. Retention members are positioned on either side of the planar portion. The retention members extend from the second surface in a direction away from the first surface.

An embodiment is directed to a terminal protection plate for use with an electrical connector. The terminal alignment plate includes a planar member with a first surface and an oppositely facing second surface. Rigid support members extend from the first surface in a direction away from the second surface. The support members extend perpendicular to the planar member. The support members have elastically deformable support beams which extend between the support members. The elastically deformable support beams extends essentially parallel to the planar member.

An embodiment is directed to a method of protecting terminals in an electrical connector, the method includes positioning, in a first position, a flexible support beam of a terminal alignment and protection plate in a terminal alignment member receiving channel which extends into a housing of the electrical connector. The flexible support beam is positioned between a first retention projection and a second retention projection which extend into the terminal alignment member receiving channel, maintaining the terminal alignment and protection plate spaced from a mating surface of the housing of the electrical connector. The method includes moving the flexible support beam from the first position to a second position causing the flexible support beam to resiliently deform as the flexible support beam engages the second retention projection. The method also includes positioning, in a second position, the flexible support beam of the terminal alignment and protection plate in the terminal alignment member receiving channel. The flexible support beam is positioned below the second retention projection allowing the terminal alignment and protection plate to engage the mating surface of the electrical connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
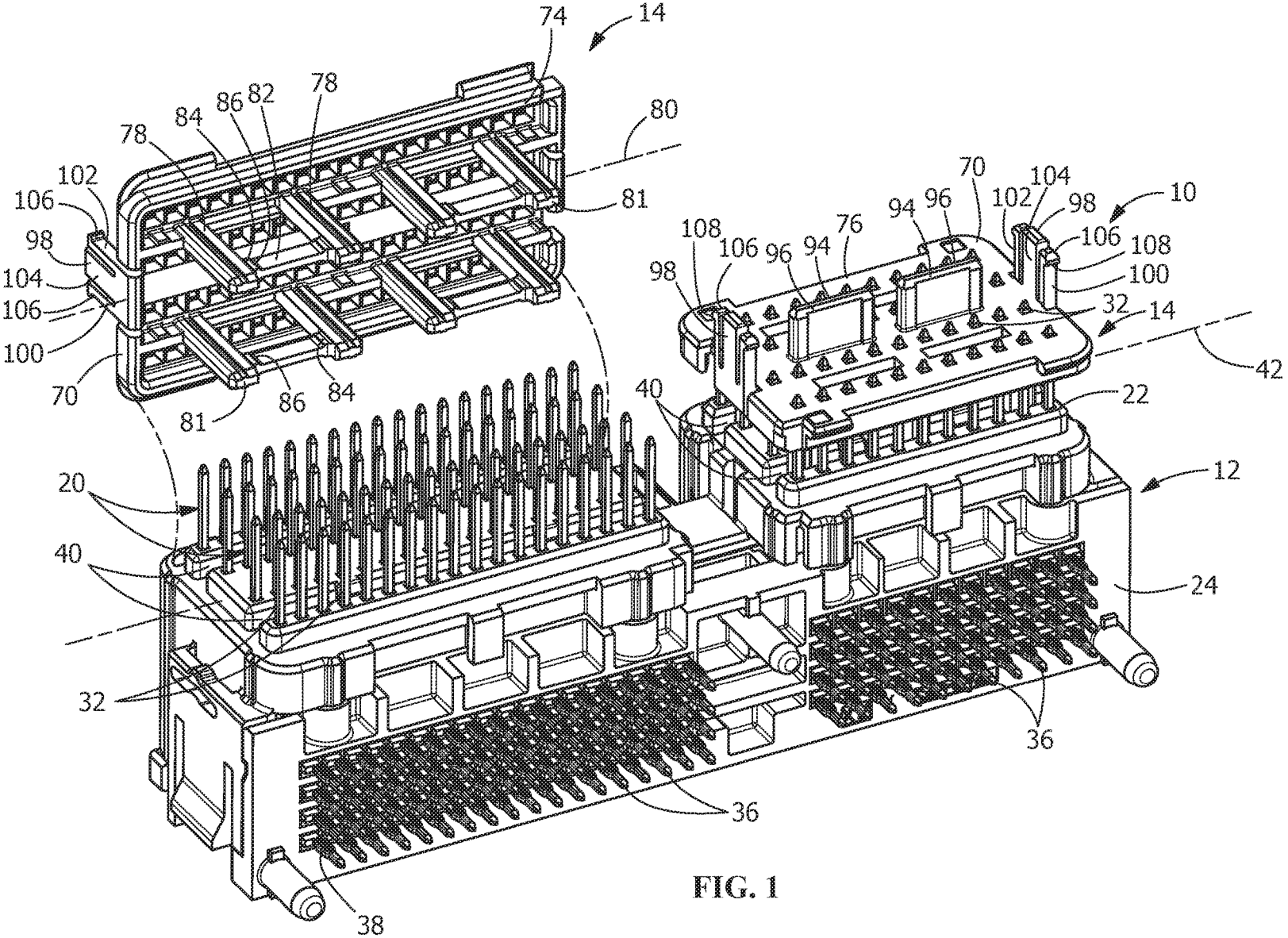
FIG. 1 is a perspective view of an illustrative electrical connector assembly of the present invention, with a terminal alignment and protection plate shown in a first position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As shown in FIG. 1, a header connector assembly 10 includes a housing assembly 12 and a pin or terminal alignment and protection plate 14. Contacts or terminals 20 are provided in the housing 12. The contacts or terminals 20 may be pin contacts, tabs, or other known types of contacts.

As shown in FIGS. 5 through 8, the housing assembly 12 has a mating surface 22 and a mounting surface 24. In the illustrative embodiment shown, the mating surface 22 extends perpendicular to the mounting surface 24. However, other configurations, of the housing 12, such as, but not limited to, the mating surface 22 extending parallel to the mounting surface 24 may be used. Also, in the illustrative embodiment, the housing assembly 12 is formed by aligning a first housing 26, with the mating surface 22 provided thereon, and a second housing 28, with the mounting surface 24 provided thereon. However, the housing assembly 12 may have other configuration, such as, but no limited to, a single housing. Terminal receiving cavities 30 extend from the mating surface 22 to the mounting surface 24. The terminal receiving cavities 30 in the illustrative embodiment shown have different configurations depending upon their respective position in the housing assembly 12. However, in other embodiments, the terminal receiving cavities 30 may all have the same configuration.

The contacts or terminals 20 have mating portions 32, securing portions 34 and mounting portions 36. The mating portions 32 extend from the mating surface 22 in a direction away from the housing assembly 12. In the illustrative embodiment shown, the mating portions 32 are in the form of pin contacts, however, other types of contacts, including, but not limited to, tabs may be used. The securing portions 34 are configured to be positioned in the terminal receiving cavities 30. The securing portions 34 may have securing projections or shoulders (not shown) to retain the securing portions 34 in the terminal receiving cavities 30. The mounting portions 36 extend from the mounting surface 24 in a direction away from the housing assembly 12. The mounting portions 36 may have compliant sections 38 (FIG. 1), or other types of mounting sections, provided thereon. In the embodiment shown, the securing portions 34 of the terminals 20 have different configurations to accommodate the different size terminal receiving cavities 30.

The securing portions 34 in the illustrative embodiment shown have different configurations depending upon their respective position in the housing assembly 12 and which of the terminal receiving cavities 30 they are positioned. However, in other embodiments, the securing portions 34 may all have the same configuration.

The housing assembly 12 has terminal alignment member receiving channels 40 which extend from the mating surface 22. In the illustrative embodiment, the terminal alignment member receiving channels 40 extend in a direction which is parallel to a longitudinal axis 42 (FIG. 1) of the housing assembly 12. In the embodiment shown, two terminal alignment member receiving channels 40 are provided. The terminal alignment member receiving channels 40 are symmetrically offset from the longitudinal axis 42 of the housing assembly 12. However, other numbers and positioning of the terminal alignment member receiving channels 40 may be used without departing from the scope of the invention.

As shown in FIGS. 5 through 8, the terminal alignment member receiving channels 40 have first projections 44 and second projections 46, both of which extend into the respective terminal alignment member receiving channels 40. The channels 40 have outer side walls 48 and oppositely facing inner side walls 50. The inner side walls 50 of the channels 40 are positioned closer to the longitudinal axis 42 than the outer side walls 48.

The first projections 44 extend into the channels 40 from the inner side walls 50 toward the outer side walls 48. The first projections 44 are positioned proximate the mating surface 22. The first projections 44 extend partially into the channels 40 from the inner side walls 50 toward the outer side walls 48, but do not engage the outer side walls 48, providing spaces 52 between free ends 54 of the first projections 44 and the outer side walls 48. The first projections 44 have lead-in surfaces 56 which extend from the mating surface 22 to the free ends 54. Securing shoulders 58 are provided on the first projections 44. The securing shoulders 58 are spaced from the mating surface 22 and extend from the inner side walls 50 to the free ends 54. The securing shoulders 58 are angled with respect to the inner wall 50.

The second projections 46 extend into the channels 40 from the outer side walls 48 toward the inner side walls 50. The second projections 46 are spaced from the mating surface 22 and are spaced from the first projections 44. The second projections 46 extend partially into the channels 40 from the outer side walls 48 toward the inner side walls 50, but do not engage the inner side walls 50, providing spaces 62 between free ends 64 of the second projections 46 and the inner side walls 50. The second projections 46 have lead-in surfaces 66 which extend from the outer side walls 48 to the free ends 64. Securing shoulders 68 are provided on the second projections 46. The securing shoulders 68 extend from the outer side walls 48 to the free ends 64. The securing shoulders 68 are positioned closer to the first projections 44 than are the lead-in surfaces 66. The securing shoulders 68 are sloped and are not perpendicular to the outer side walls 48.

While the first projections 44 are shown extending from the inner side walls 50 and the second projections 46 are shown extending from the outer side walls 48, the first projections 44 may extend from the outer side walls 48 and the second projections 46 may extend from the inner side walls 50.

Figure 2:
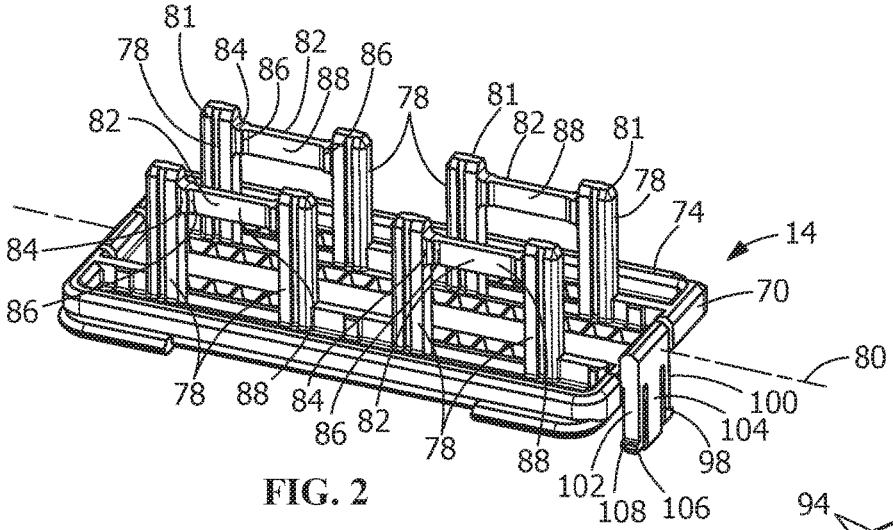
FIG. 2 is a top perspective view of the terminal alignment and protection plate.
Figure 3:
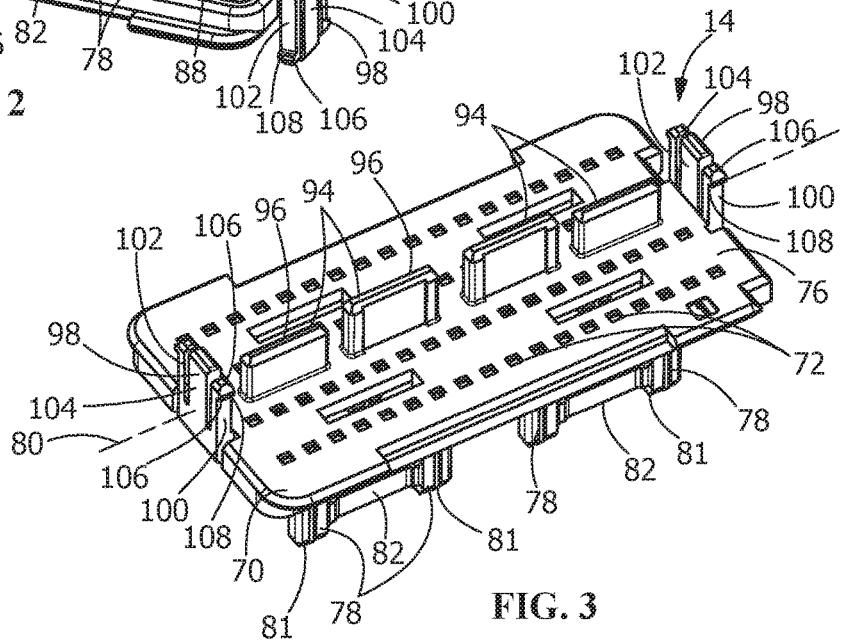
FIG. 3 is a bottom perspective view of the terminal alignment and protection plate.
Figure 4:
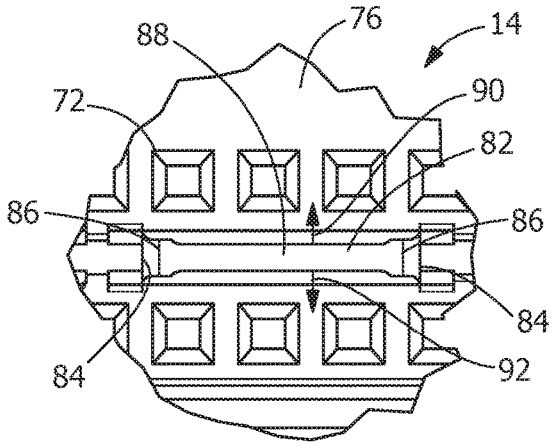
FIG. 4 is an enlarged view of a resilient beam of the terminal alignment and protection plate.

As shown in FIGS. 2 through 4, the alignment plate 14 includes a main planar portion 70 with a plurality of terminal receiving openings 72 extending therethrough. The planar portion 70 has a first surface 74 and oppositely facing second surface 76. The first surface 74 is positioned to face the mating surface 22, as shown in FIG. 1. Support members or legs 78 extend from the first surface 74 is a direction away from the second surface 76. In the embodiment shown, two rows of support legs 78 are provided with three support legs 78 in each row. However, other numbers and configurations of the support legs 78 may be provided. Each row of support legs 78 extends in a line which is parallel to a longitudinal axis 80 of the planar portion 70 and parallel to the longitudinal axis 42 of the housing assembly 12. Each row of support legs 78 is positioned in line with respective terminal alignment member receiving channels 40. The support legs 78 have angled lead-in surfaces 81 provide at free ends thereof. The support legs 78 are rigid beams which extend perpendicular to the planar portion 70.

Elastically deformable support beams 82 extend between the support legs 78. The support beams 82 have fixed ends 84 which are attached to the support legs 78. The fixed ends 84 have enlarged portions 86 to provide proper support and stiffening to the fixed ends 84. Midsections 88 of the support beams 82 extend between the enlarged portions 86. The cross-sectional area of the midsections 88 of the support beams 82 is less than the cross-sectional area of the enlarged portions 86, thereby allowing the midsections 88 to resiliently deform or flex in directions which are perpendicular to the line of the rows of the support legs, as indicated by the arrows 90, 92 shown in FIG. 4.

Alignment ribs 94 extend from the second surface 76 of the planar portion 70 in a direction away from the first surface 74. The alignment ribs 94 extend perpendicular to the second surface 76. The alignment ribs 94 have tapered or lead-in free ends 96. In the embodiment shown, the alignment ribs 92 are spaced along the longitudinal axis 80 of the planar portion 70.

Figure 11:
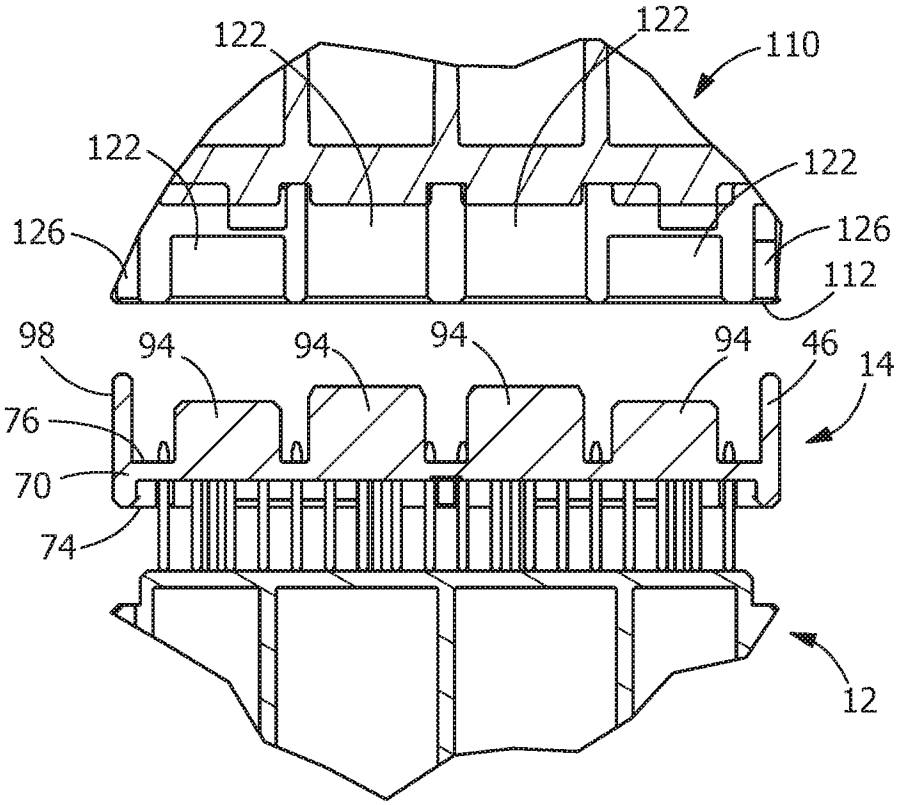
FIG. 11 is a second cross-sectional view of the connector assembly with the mating assembly shown in the first position.
Figure 13:
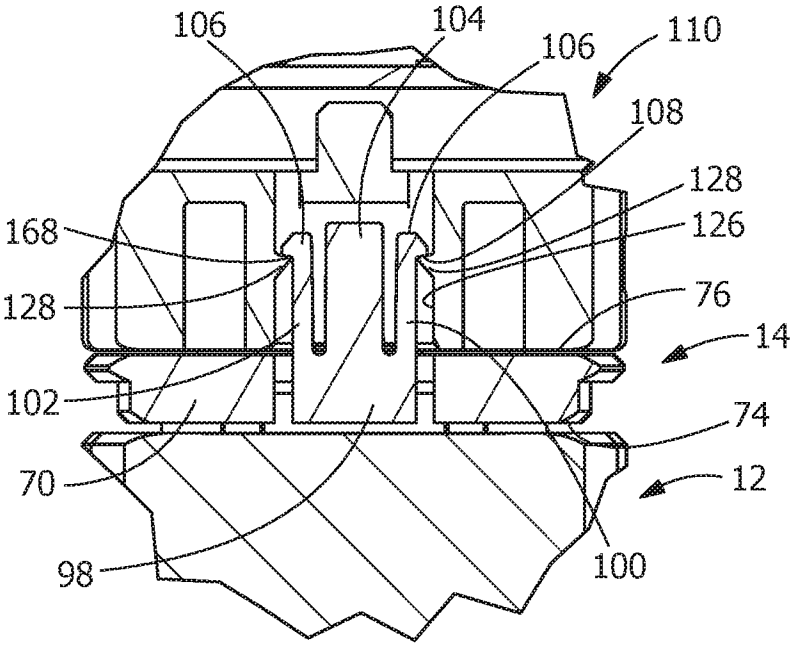
FIG. 13 is a second cross-sectional view of the connector assembly with the mating assembly shown in the second or mated position.

Retention members 98 are positioned on either side of the planar portion 70. In the illustrative embodiment shown, the retention members 98 extend across the longitudinal axis 80 of the planar portion 70. As shown in FIGS. 11 and 13, the retention members 98 extend from the second surface 76 of the planar portion 70 in a direction away from the first surface 74. The retention members 98 have first flexible spring arms 100, second flexible spring arms 102 and support members 104 positioned between the spring arms 100, 102. The spring arms 100, 102 have projections 106 which extend from a sides thereof in a direction away from the support members 104. The projections 106 have retention shoulders 108.

Figure 9:
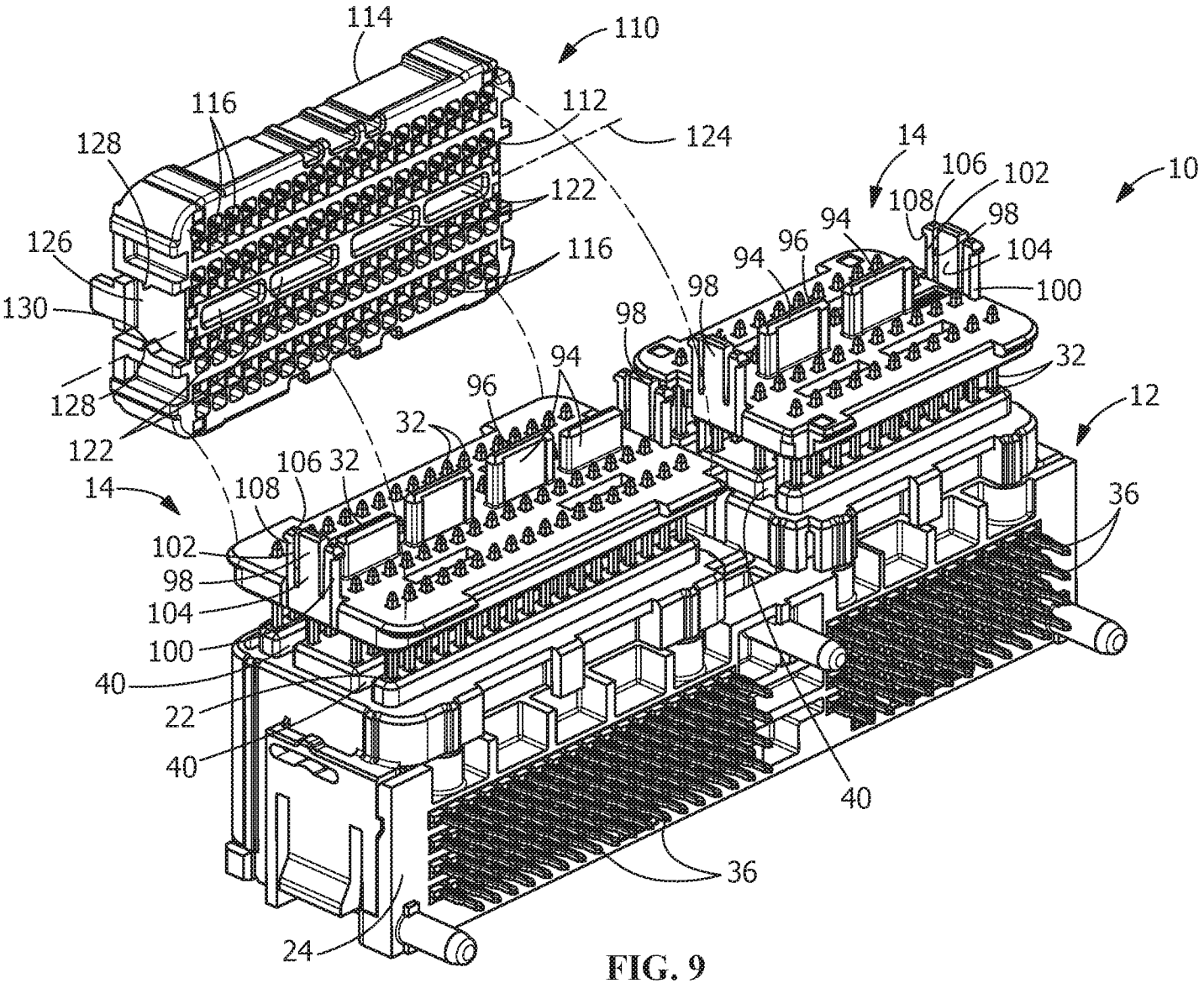
FIG. 9 is a perspective view of the illustrative electrical connector assembly of FIG. 1 with a mating assembly positioned proximate thereto.

As shown in FIG. 9, a mating connector assembly 110 has a mating surface 112 and a mounting or cable receiving surface 114. Terminal receiving cavities 116 extend from the mating surface 112 to the mounting surface 114.

Mating contacts or terminals (not shown) are positioned in terminal receiving cavities 116. The mating terminals are configured to mate with the mating portions 32 of terminals 20. In the illustrative embodiment shown, the mating terminals may be in the form of socket contacts, however, other types of contacts may be used.

Alignment rib receiving cavities 122 extend from the mating surface 112 in a direction toward the mounting surface 114. The alignment rib receiving cavities 122 are spaced along a longitudinal axis 124 (FIG. 9) of the mating connector assembly 110.

Retention member receiving slots 126 are positioned on either side of the mating connector assembly 110. In the illustrative embodiment shown, the retention member receiving slots 126 extend across the longitudinal axis 124 of the mating connector assembly 110. The retention member receiving slots 126 extend from the mating surface 112 in a direction toward the mounting surface 114. The retention member receiving slots 126 have locking projections 128 with locking shoulders 130.

Figure 5:
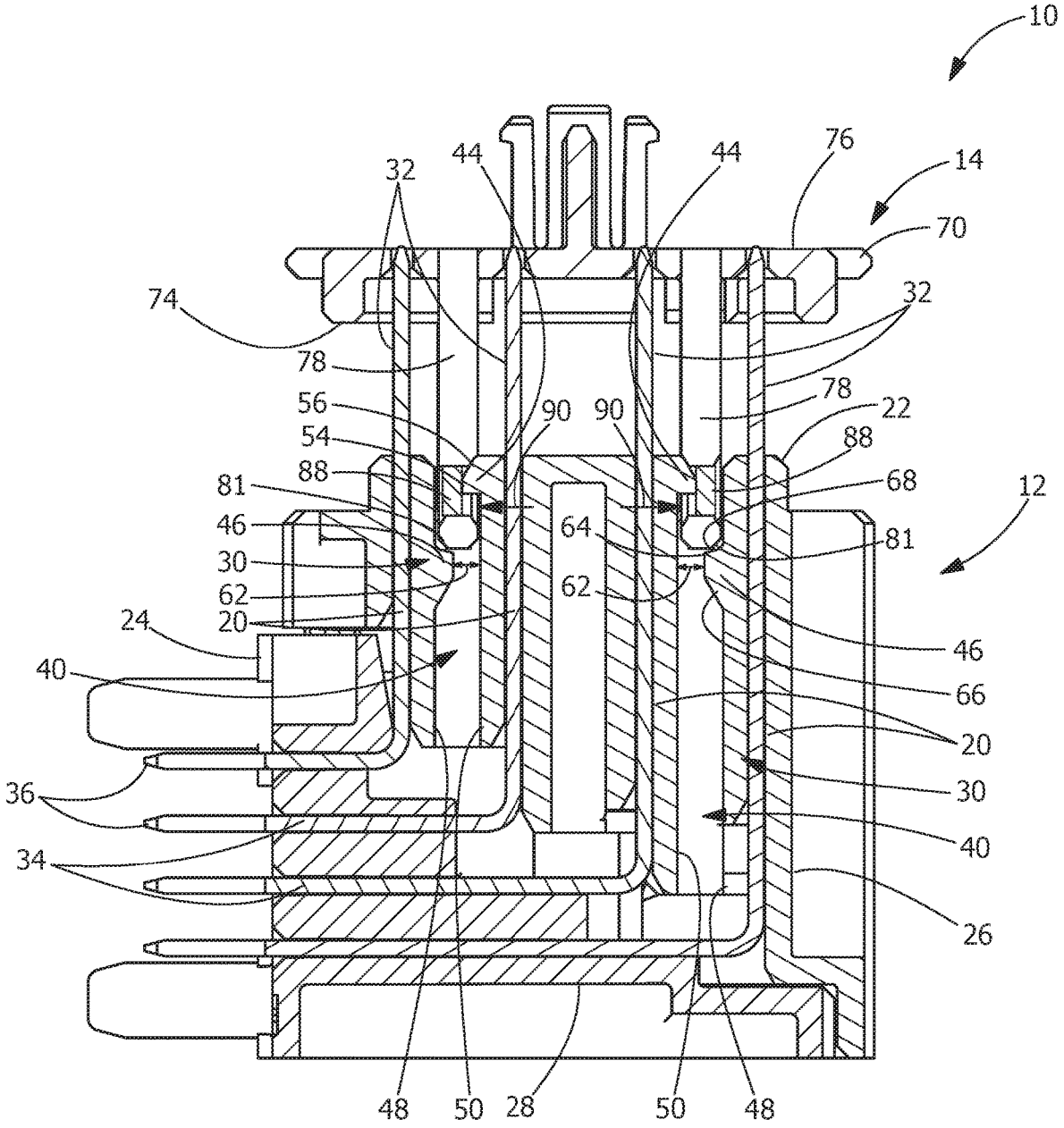
FIG. 5 is a perspective cross-sectional view of the connector assembly of FIG. 1 taken along line 5-5 of FIG. 1, with the terminal alignment and protection plate shown being moved to a first or shipping position.
Figure 6:
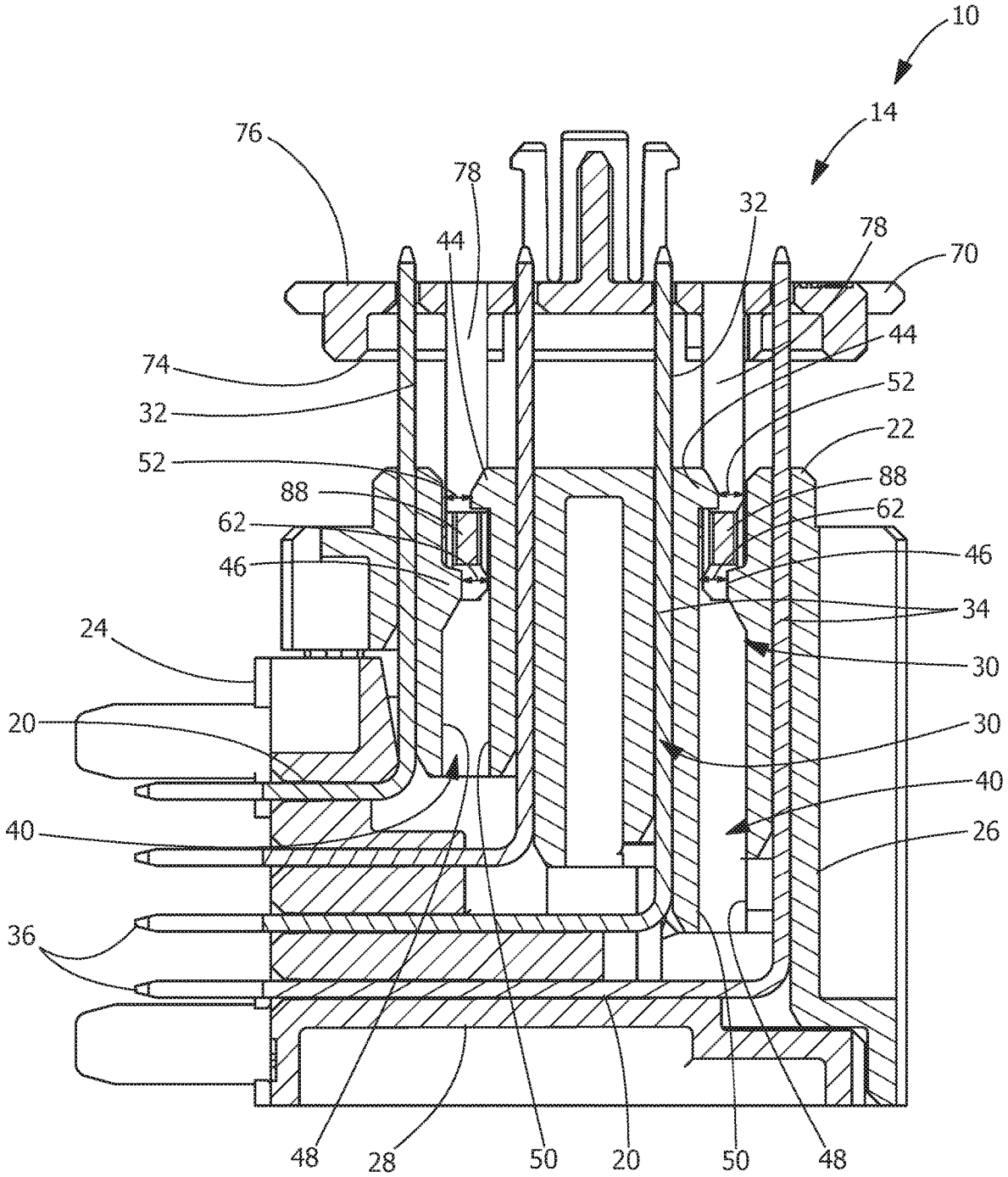
FIG. 6 is a perspective cross-sectional view of the connector assembly similar to FIG. 5, with the terminal alignment and protection plate in the first or shipping position.

In use, the terminal alignment and protection plate 14 is positioned in the housing assembly 12. Initially, as shown in FIG. 5, the lead-in surfaces 81 of the support members 78 of the terminal alignment and protection plate 14 are moved into the terminal alignment receiving channels 40 of the housing assembly 12. With the support members 78 properly aligned with the terminal alignment receiving channels 40, the protection plate 14 is pushed or moved to a first position, as shown in FIG. 6. As this occurs, the midsections 88 of the elastically deformable support beams 82 engages the lead-in surfaces 56 of the first projections 44, thereby causing the midsections 88 of the elastically deformable support beams 82 to be elastically displaced in the direction of arrow 90. Continued insertion causes the midsections 88 of the elastically deformable support beams 82 to be moved into and through the spaces 52.

Insertion continues until the midsections 88 engage the securing shoulders 68 of the second projections 46. As this occurs, the midsections 88 of the elastically deformable support beams 82 are moved past the first projections 44 and elastically return to their unstressed positions. In this position, the midsections 88 of the elastically deformable support beams 82 and the terminal alignment and protection plate 14 are maintained in the first position, as shown in FIG. 6. In the initial position, the planar portion 70 of the terminal alignment and protection plate 14 is spaced from the mating surface 22 of the housing assembly 12 to cooperate with the mating portions 32 of the terminals 20 to retain the mating portions 32 of the terminals 20 is proper position during shipping.

Figure 7:
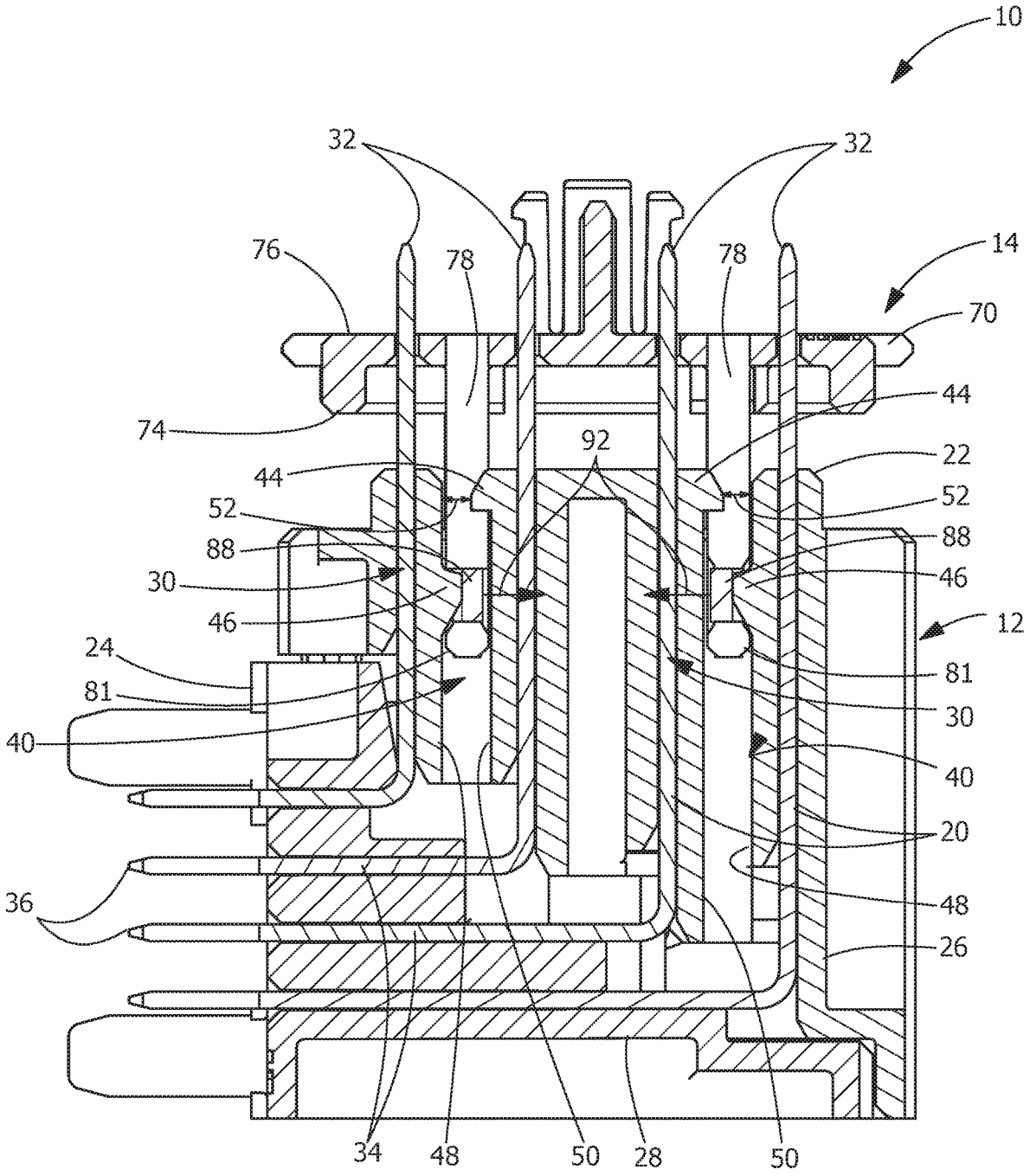
FIG. 7 is a perspective cross-sectional view of the connector assembly similar to FIG. 5, with the terminal alignment and protection plate between the first position and a second or final position.
Figure 8:
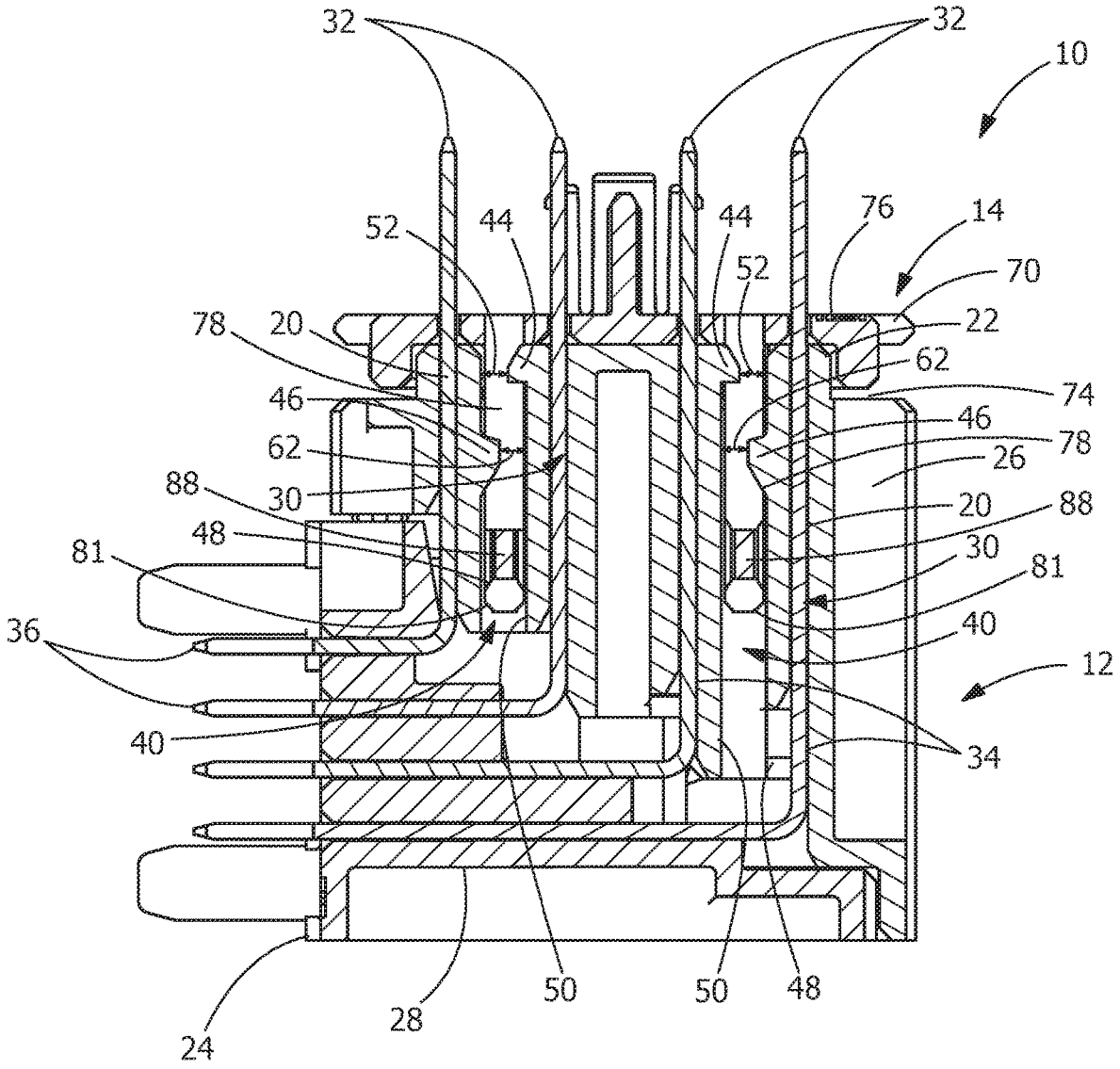
FIG. 8 is a perspective cross-sectional view of the connector assembly similar to FIG. 5, with the terminal alignment and protection plate in the second or final position.

When the header assembly 10 is mated with the mating connector 110 (FIG. 9), the mating connector 110 engages the terminal alignment and protection plate 14 and exerts a force on the terminal alignment and protection plate 14 as the mating connector 110 is mated to the header assembly 10. The force exerted by the mating connector 110 is sufficient to cause the midsections 88 of the elastically deformable support beams 82 to move past the securing shoulders 68 of the second projections 46, as shown in FIG. 7. As this occurs, the midsections 88 of the elastically deformable support beams 82 are elastically displaced in the direction of arrow 92. Continued insertion causes the midsections 88 of the elastically deformable support beams 82 to be moved into and through the spaces 62. The movement of the midsections 88 of the elastically deformable support beams 82 and the terminal alignment and protection plate 14 continues until the first surface 74 of the planar portion 70 of the terminal alignment and protection plate 14 engages the mating surface 22 of the housing assembly 12, as shown in FIG. 8. In this position, the midsections 88 of the elastically deformable support beams 82 are positioned in the terminal alignment receiving channels 40 below the second projections 46. This allows the mating connector 110 to be fully mated with the header assembly 10.

Figure 10:
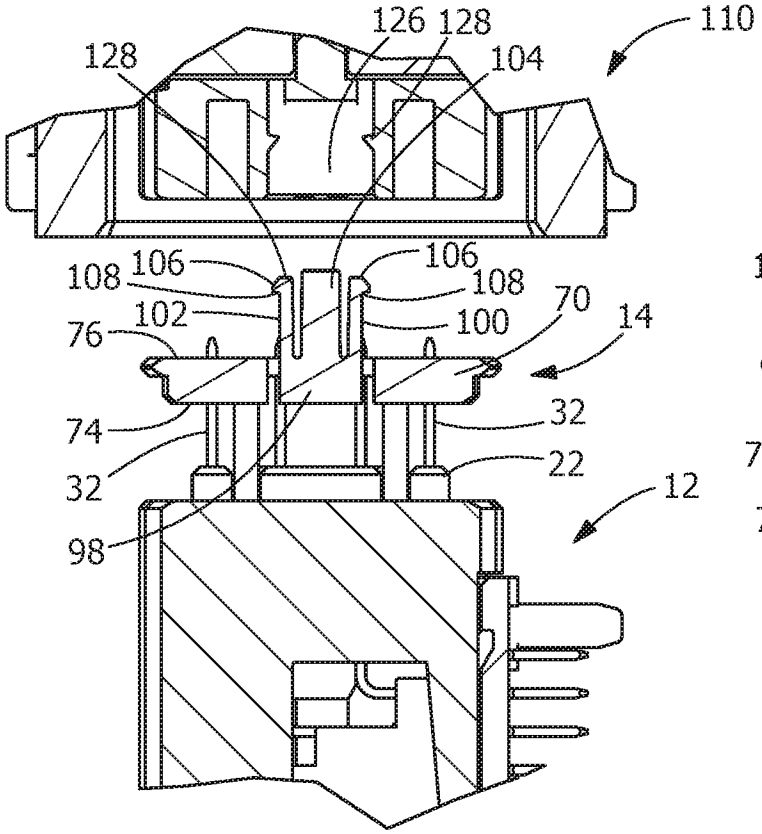
FIG. 10 is a first cross-sectional view of the connector assembly with the mating assembly shown in a first position.

In addition, when the mating connector 110 is moved into alignment with the header assembly, the alignment rib receiving cavities 122 of the mating connector 110 are aligned with the alignment ribs 94 of the terminal alignment and protection plate 14, as shown in FIG. 10. In this position, the retention member receiving slots 126 of the mating connector 110 are aligned with the retention members 98 of the terminal alignment and protection plate 14.

Figure 12:
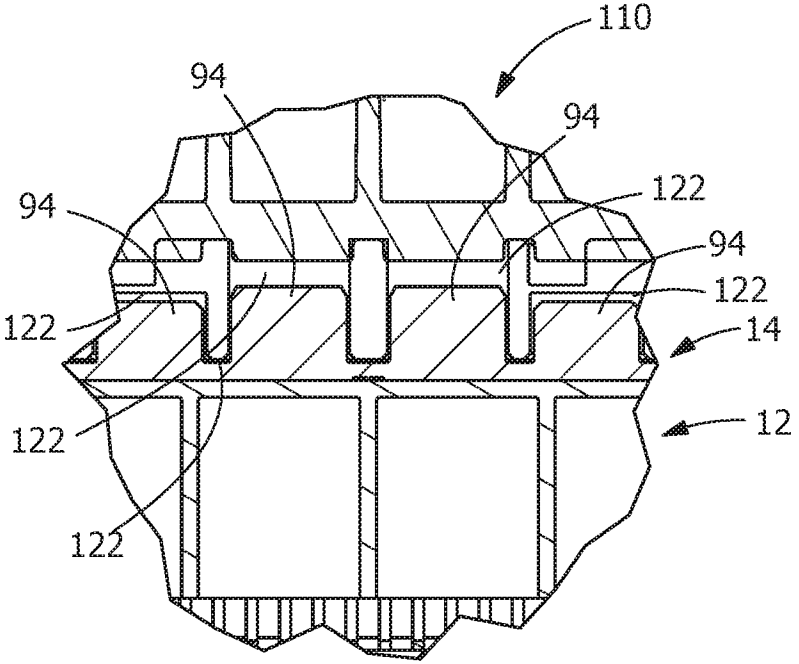
FIG. 12 is a first cross-sectional view of the connector assembly with the mating assembly shown in a second or mated position.

As the mating connector 110 is mated with the header assembly 10, the mating surface 112 of the mating connector 110 engages the second surface 76 of the planar member 70 of the terminal alignment and protection plate 14. As this occurs, the alignment rib receiving cavities 122 of the mating connector 110 receive the alignment ribs 94 of the terminal alignment and protection plate 14 therein, as shown in FIG. 12. If the mating connector 110 is slightly misaligned with the header assembly 10, the tapered ends 96 of the alignment ribs 94 cooperate with the alignment rib receiving cavities 122 to guide the mating connector 110 to the proper position.

As the mating connector 110 is mated with the header assembly 10, the retention member receiving slots 126 of the mating connector 110 receive the retention members 98 of the terminal alignment and protection plate 14 therein, as shown in FIG. 12. As insertion continues, the projections 106 of the spring arms 100, 102 engage the locking projections 128 of the mating connector 110, causing the spring arms 100, 102 to resiliently deform inward toward the support members 104. The insertion of the mating connector 110 continues until the first surface 74 of the planar portion 70 of the terminal alignment and protection plate 14 engages the mating surface 22 of the housing assembly 12, as shown in FIG. 12. In this final or fully inserted position, the projections 106 of the spring arms 100, 102 are moved past the locking projections 128 of the mating connector 110, allowing the spring arms 100, 102 to return toward their unstressed position. In this position, the retention shoulders 108 engage the locking shoulders 130, thereby preventing the inadvertent movement of the mating connector 110 from the terminal alignment and protection plate 14 and the header assembly 10.

The configuration of the first projections 44 and the second projections 46 of the terminal alignment receiving channels 40 and the midsections 88 of the elastically deformable support beams 82 allows the terminal alignment and protection plate 14 to be properly positioned and maintained in the first position prior to the header assembly 10 being mated with a mating connector 110. The use of the alignment ribs 94 and retention members 98 properly aligns and secures the mating connector 110 to the header assembly 10.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

We claim:

1. An electrical connector assembly comprising:

a housing having a plurality of terminals mounted in the housing with terminal mating portions projecting from a mating surface of the housing, the mating surface having terminal alignment member receiving channels which extend into the housing, the terminal alignment member receiving channels having first retention projections and second retention projections extending into the terminal alignment member receiving channels;

a terminal alignment and protection plate having a plurality of terminal receiving openings for receiving mating portions of the terminals therein, the terminal alignment and protection plate having a first surface and an oppositely facing second surface, the first surface facing the mating surface of the housing;

rigid support members extending from the first surface of the terminal alignment and protection plate in a direction away from the second surface, the support members extending perpendicular to a planar portion of the terminal alignment and protection plate, the support members having flexible support beams extending between the support members, the flexible support beams extending essentially parallel to the planar portion of the terminal alignment and protection plate;

wherein when the terminal alignment and protection plate is spaced from the mating surface of the housing, the flexible support beams are provided in the terminal alignment member receiving channels and are retained between the first retention projections and the second retention projections;

wherein when the terminal alignment and protection plate is adjacent the mating surface of the housing, the flexible support beams are provided in the terminal alignment member receiving channels and are positioned beyond the second retention projections.

2. The electrical connector assembly as recited in claim 1, wherein the terminal alignment member receiving channels extend in a direction which is parallel to a longitudinal axis of the housing assembly.

3. The electrical connector assembly as recited in claim 2, wherein, the terminal alignment member receiving channels are two terminal alignment member receiving channels which are symmetrically offset from the longitudinal axis of the housing assembly.

4. The electrical connector assembly as recited in claim 2, wherein the terminal alignment member receiving channels have outer side walls and oppositely facing inner side walls, the inner side walls of the channels are positioned closer to the longitudinal axis of the housing than the outer side walls, the first projections extend into the terminal alignment member receiving channels from the inner side walls toward the outer side walls, the second projections extend into the terminal alignment member receiving channels from the outer side walls toward the inner side walls.

5. The electrical connector assembly as recited in claim 4, wherein the first projections are positioned proximate the mating surface, the first projections extend partially into the terminal alignment member receiving channels from the inner side walls toward the outer side walls, first spaces are between free ends of the first projections and the outer side walls.

6. The electrical connector assembly as recited in claim 5, wherein the first projections have lead-in surfaces which extend from the mating surface to the free ends of the first projections, securing shoulders are provided on the first projections, the securing shoulders are spaced from the mating surface and extend from the inner side walls to the free ends, the securing shoulders extend in a direction which is essentially perpendicular to the inner wall.

7. The electrical connector assembly as recited in claim 5, wherein the second projections extend into the terminal alignment member receiving channels from the outer side walls toward the inner side walls, the second projections are spaced from the mating surface and are spaced from the first projections, the second projections extend partially into the terminal alignment member receiving channels from the outer side walls toward the inner side walls, second spaces are provided between free ends of the second projections and the inner side walls.

8. The electrical connector assembly as recited in claim 7, wherein the second projections have lead-in surfaces which extend from the outer side walls to the free ends, securing shoulders are provided on the second projections, the securing shoulders extend from the outer side walls to the free ends, the securing shoulders are sloped and are not perpendicular to the outer side walls.

9. The electrical connector assembly as recited in claim 1, wherein the terminal alignment and protection plate includes a main planar portion with the first surface and the oppositely facing second surface provided thereon, the support members are positioned in one or more rows with extend parallel to a longitudinal axis of the planar portion and parallel to the longitudinal axis of the housing assembly, each row of the support members is positioned in line with respective terminal alignment member receiving channels.

10. The electrical connector assembly as recited in claim 9, wherein the support members have angled lead-in surfaces provide at free ends the support members.

11. The electrical connector assembly as recited in claim 9, wherein the flexible support beams have fixed ends which are attached to the support members, the fixed ends have enlarged portions, midsections of the support beams extend between the enlarged portions, the cross-sectional area of the midsections of the support beams is less than the cross-sectional area of the enlarged portions, thereby allowing the midsections to resiliently deform or flex in directions which are perpendicular to the longitudinal axis of the housing assembly.

12. The electrical connector assembly as recited in claim 1, wherein alignment ribs extend from the second surface of the terminal alignment and protection plate in a direction away from the first surface, the alignment ribs extend perpendicular to the second surface.

13. The electrical connector assembly as recited in claim 12, wherein the alignment ribs have tapered free ends, the alignment ribs are spaced along a longitudinal axis of the terminal alignment and protection plate.

14. The electrical connector assembly as recited in claim 12, wherein retention members are positioned on either side of the terminal alignment and protection plate, the retention members extend from the second surface of the terminal alignment and protection plate in a direction away from the first surface.

15. The electrical connector assembly as recited in claim 14, wherein the retention members have first flexible spring arms, second flexible spring arms and support members positioned between the spring arms, the spring arms have projections which extend from sides of the spring arms in a direction away from the support members, the projections have retention shoulders.

16. An electrical connector assembly comprising:

a housing having a plurality of terminals mounted in the housing with terminal mating portions projecting from a mating surface of the housing;

a terminal alignment and protection plate having a planar portion with a plurality of terminal receiving openings for receiving mating portions of the terminals therein, the planar portion having a first surface and an oppositely facing second surface, the first surface facing the mating surface of the housing;

alignment ribs extending from the second surface of the planar portion of the terminal alignment and protection plate in a direction away from the first surface, the alignment ribs extending perpendicular to the second surface;

retention members positioned on either side of the planar portion, the retention members extending from the second surface in a direction away from the first surface;

rigid support members extending from the first surface of the planar portion of the terminal alignment and protection plate in a direction away from the second surface, the support members having flexible support beams extending between the support members.

17. The electrical connector assembly as recited in claim 16, wherein the rigid support members extend perpendicular to the planar portion, the flexible support beams extend essentially parallel to the planar portion.

18. The electrical connector assembly as recited in claim 17, wherein the housing has a mating surface having terminal alignment member receiving channels which extend into the housing, the terminal alignment member receiving channels have first retention projections and second retention projections which extend into the terminal alignment member receiving channels, the terminal alignment member receiving channels have outer side walls and oppositely facing inner side walls, the inner side walls of the channels are positioned closer to the longitudinal axis of the housing than the outer side walls, the first projections extend into the terminal alignment member receiving channels from the inner side walls toward the outer side walls, the second projections extend into the terminal alignment member receiving channels from the outer side walls toward the inner side walls.

19. The electrical connector assembly as recited in claim 18, wherein the first projections are positioned proximate the mating surface, the first projections extend partially into the terminal alignment member receiving channels from the inner side walls toward the outer side walls, first spaces are between free ends of the first projections and the outer side walls, the second projections extend into the terminal alignment member receiving channels from the outer side walls toward the inner side walls, the second projections are spaced from the mating surface and are spaced from the first projections, the second projections extend partially into the terminal alignment member receiving channels from the outer side walls toward the inner side walls, second spaces are provided between free ends of the second projections and the inner side walls.

20. A terminal protection plate for use with an electrical connector, the terminal alignment plate comprising:

a planar member having a first surface and an oppositely facing second surface;

rigid support members extending from the first surface in a direction away from the second surface, the support members extending perpendicular to the planar member, the support members having elastically deformable support beams extending between the support members, the elastically deformable support beams extending essentially parallel to the planar member.

* * * * *